US006237794B1

(12) United States Patent
Fenton et al.

(10) Patent No.: US 6,237,794 B1
(45) Date of Patent: May 29, 2001

(54) STACKING POST TOP CASTING

(75) Inventors: Gary L. Fenton, Edgerton; Jeffrey W. Liebelt, Janesville, both of WI (US)

(73) Assignee: Stoughton Trailers, Inc., Stoughton, WI (US)

( * ) Notice: Subject to any disclaimer, the term of this patent is extended or adjusted under 35 U.S.C. 154(b) by 0 days.

(21) Appl. No.: 09/522,090

(22) Filed: Mar. 10, 2000

Related U.S. Application Data

(60) Provisional application No. 60/163,815, filed on Nov. 5, 1999.

(51) Int. Cl.[7] ..... B65D 88/00
(52) U.S. Cl. ..... 220/1.5
(58) Field of Search ..... 220/1.5; 294/68.3, 294/68.1

(56) References Cited

U.S. PATENT DOCUMENTS

| | | | |
|---|---|---|---|
| 2,962,323 | 11/1960 | McBride . | |
| 3,003,810 | 10/1961 | Kloote et al. . | |
| 3,128,897 | 4/1964 | Wilkins . | |
| 3,294,419 | * 12/1966 | Martin et al. | 220/1.5 X |
| 3,401,814 | 9/1968 | Chiswell et al. . | |
| 3,456,829 | 7/1969 | Glassmeyer . | |
| 3,561,633 | 2/1971 | Morrison et al. . | |
| 3,691,595 | 9/1972 | Backteman et al. . | |
| 3,776,169 | 12/1973 | Strecker . | |
| 3,801,177 | 4/1974 | Fylling et al. . | |
| 3,854,620 | 12/1974 | Saidla . | |
| 3,907,148 | 9/1975 | Meller et al. . | |
| 4,144,984 | 3/1979 | Saunders . | |
| 4,258,520 | 3/1981 | Rehbein . | |
| 4,271,975 | 6/1981 | Ketner et al. . | |
| 4,325,488 | 4/1982 | Ketner . | |
| 4,366,905 | 1/1983 | Forshee . | |
| 4,505,402 | 3/1985 | Gerhard . | |
| 4,576,300 | 3/1986 | Kedzior . | |
| 4,589,565 | 5/1986 | Spivey . | |
| 4,626,155 | 12/1986 | Hlinsky . | |
| 4,729,570 | 3/1988 | Welch, Jr. . | |
| 4,730,428 | 3/1988 | Head et al. . | |
| 4,810,027 | 3/1989 | Ehrlich . | |
| 4,940,279 | 7/1990 | Abott et al. . | |
| 4,944,421 | 7/1990 | Yurgevich . | |
| 5,072,845 | 12/1991 | Grogan . | |
| 5,178,292 | 1/1993 | Korzeniowski . | |
| 5,265,748 | 11/1993 | Furukawa . | |
| 5,279,436 | 1/1994 | Elliot et al. . | |
| 5,348,175 | 9/1994 | Reynard . | |
| 5,449,082 | 9/1995 | Reynard . | |
| 5,507,405 | 4/1996 | Thomas et al. . | |
| 5,678,715 | 10/1997 | Sjostedt et al. . | |

OTHER PUBLICATIONS

Stoughton Drawing No. 04–12314, Revision B, dated Mar. 12, 1990.
Stoughton Drawing No. 04–13776, Revision D, dated Jun. 2, 1992.
Stoughton Drawing No. 04–14891, dated Jan. 4, 1994.
Stoughton Drawing No. 04–18581, dated Jan. 8, 1999.

* cited by examiner

*Primary Examiner*—Steven Pollard
(74) *Attorney, Agent, or Firm*—Michael Best & Friedrich LLP

(57) ABSTRACT

A top casting for stacking frames of cargo containers. The top casting has an aperture for stacking and top picking non-standard cargo containers. The top casting also has a cavity that is configured to allow for the insertion and rotation of a standard top-picking device. The top casting positions the aperture near the outboard wall of the cargo container to reduce moment stresses caused by stacking and lifting. The outboard wall of the casting is provided with an internal recess adequate to allow the rotation of a lifting device head after it has been inserted into the cavity of the top casting. The aperture of each top casting is capable of receiving a top picking device and its axis is located at a distance no greater than 3 inches from the outboard wall of the cargo container so as to position the aperture as near as possible to the stacking post.

22 Claims, 4 Drawing Sheets

STACKING POST TOP CASTING

This Appln claims the benefit of Provisional No. 60/163,815 filed Nov. 5, 1999.

FIELD OF THE INVENTION

The present invention relates to stacking post top castings for cargo containers, and more specifically, to stacking post top castings adapted to allow for the top picking of such containers through a stacking post casting aperture located near the container outboard wall.

BACKGROUND OF THE INVENTION

Cargo containers are the standard and most popular means for shipping materials by trucks, trains, and ships. Typically, several lifting points are located on the exterior of the containers to facilitate handling. Uniform lifting points are typically used so as to allow vehicular cranes or marine cranes to load or unload cargo containers onto flat bed trucks, railroad cars, or ocean-going vessels.

To meet the high demands of economical shipping, manufacturers are increasing the size of the cargo containers to create more shipping capacity per container. Specifically, these modern containers are being made wider than the pre-existing containers. These wider containers locate the top casting aperture, used for stacking and lifting the container, a greater distance from outboard wall of the container. The effect of increasing the distance of the aperture from the outboard wall and increasing the size and weight of the container is substantially higher stresses on the stacking frame when the container is stacked or lifted. One solution introduced to reduce these stresses is to move the aperture closer toward the outboard wall. However, these top castings fail to provide adequate space and strength to allow the containers to be lifted by a top picking apparatus. A solution is needed, therefore, that provides a top casting that positions the aperture closer to the outboard wall of a container to reduce stresses caused by stacking and lifting, and that at the same time provides adequate space and strength to permit top lifting operations.

Cargo container lifting devices currently in use are typically shaped to be inserted into top castings at the lifting points on the cargo containers and can be turned or twisted in the top casting to be secured therein. These lifting devices are usually T-shaped and are presented in one angular setting to be received by conventional top castings. Each top casting provides an upwardly opening aperture for receiving the lifting device. Typically, after the lifting device is inserted into the aperture of the top casting, the lifting device is then rotated through 90° to a locking position. Once all lifting devices are locked to their respective top castings, the crane can begin lifting operations.

Standard cargo containers are manufactured in lengths of 10 feet, 20 feet, 30 feet, and 40 feet. Lifting points for these standard sized containers are generally located at or near the roof corners of the containers. The corner top castings have the benefit of two intersecting walls for support, namely the adjoining side wall and the end wall. In addition, the interconnection of a horizontal support between these top castings and a vertical post located at the intersection of the two walls aids in the structural integrity of the container.

Cargo containers also are manufactured in non-standard lengths in order to accommodate larger payloads while reducing associated shipping costs. These non-standard lengths are generally found in excess of 40 feet. Standard vehicular cranes and marine cranes must be capable of lifting such non-standard length containers. Therefore, lifting points are typically located or added at positions inboard from the ends of the containers. Lift fittings in the form of top castings are located at these lifting points. International standards require these top castings to be separated by 39 feet-4 inches center to center of the apertures.

Because the lifting points just described are located inboard from the ends of the container, a different support structure is required. These support frames are built into the structure of the containers. Although support frames are common for securing top castings, support frames do not provide as much support strength and rigidity as is available for the corner top castings on the standard length containers. Each support frame typically includes horizontal support members, vertical stacking posts, bottom castings and top castings. The upper horizontal support member extends between the side walls and is secured to the top castings. The lower horizontal support member extends between the side walls and is secured to the bottom castings. The vertical stacking posts support the side walls and couple respective top and bottom castings.

To facilitate secure and uniform stacking of cargo containers, bottom castings also include a downwardly opening aperture located from the outboard side a distance equal to the aperture of the top casting. International standards require 39 feet-4 inches between support frames and 89 inches between the apertures of each top casting set located a distance along the length of the cargo container. This standard spacing, along with the 40-foot standard spacing along the length of the container mentioned earlier, provides standard stacking points on cargo containers. These standards in turn allow for non-standard sized containers to be stacked with other containers. In order to lock stacked containers into place, IBC connectors are used between the top castings of a lower cargo container and the bottom castings of an upper cargo container. IBC connectors are container securement devices having upper and lower securing heads, similar to that of a top picking device. After the IBC connector head is located within the apertures of the top and bottom castings, the heads are rotated, locking the stacked cargo containers together. It should be noted that throughout the specification and claims herein, "connecting device" is defined as either a connecting device for an IBC connector or a connecting device for a top picker, or any other releasable engaging device used to connect the stacking post top casting via a top aperture to another conventional object or objects for stacking or lifting purposes.

Cargo containers have historically been manufactured to an exterior width that maintained the 89-inch separation between the apertures of the top castings to accommodate standard lifting devices. However, many more recent cargo containers have been manufactured with an increased width to increase cargo space. As a result, the top castings have become longer to maintain the coupling between the container side wall and the lift point of each top casting. In other words, the 89-inch distance between apertures of the top castings remains the same, but the distance between container side walls has increased, resulting in the need for longer top castings. Therefore, the distance between the aperture of each casting and the side wall of the container has increased.

Consequences of this increased distance are increased loads transferred to the stacking post and header during stacking and lifting operations. Because of the increased lateral spacing between these components, a longer moment arm subjects the stacking post to a larger torque loading. This type of loading has therefore introduced the necessity to provide additional strength to the support frames to withstand the loads imposed during stacking and lifting. Unfortunately, this increase in strength results in increased container weight, increased structural component size, decreased container capacity, and increased manufacturing costs.

One technique adopted to solve this problem, introduced by J. B. Hunt, is to position the aperture of each top casting closer to the outboard walls of the cargo container. For example, in a 102⅜ inch wide cargo container, the apertures are located 3.0" from the outboard walls. This creates a distance of 96⅜ inches between corresponding top casting apertures, as opposed to the standard 89 inches of previous containers. This change in position decreases the length of the moment arm acting on the stacking post from the stacking forces transferred to the top casting at its aperture. The new aperture position has the effect of moving the applicable force closer to the axis of the stacking post, so as to provide the stacking post with better leverage against the induced stresses. With reduced stress, the overall weight of the frame and each top casting, the amount of intrusion into the cargo space, and the amount of equipment maintenance can be reduced. Although these top castings permit side lifting of the cargo container via a side aperture located on the outboard side of each top casting, they do not permit cargo container top lifting for various reasons. First, the cavity within this top casting does not allow adequate space for the top lifting device to fully penetrate the aperture (which is necessary to rotate the device head into the locked position). Second, even if the lifting device could fully penetrate the aperture, the internal walls of the top casting, specifically the outboard wall, would interfere with the rotation of the lifting device head. Third, it is questionable whether these top casting possess the strength characteristics necessary to allow lifting of the cargo container by the top apertures.

Due to the modified 96⅜ inch spacing between apertures, it has become desirable to manufacture cargo containers that are compatible with both the 96⅜ inch spacing as well as the standard 89 inch spacing for stacking purposes. To this effect, some J. B. Hunt containers have a top casting that has an outboard aperture located 3.0 inches from the outboard container wall as well as an inboard aperture located 6 11/16 inches from the outboard container wall. Therefore, a 102⅜ wide cargo container equipped with this top casting can be stacked with either a container utilizing the 96⅜ inch spacing or the 89 inch spacing. However, like their counterpart top casting described earlier, these top castings do not permit top lifting operations and, instead, must be lifted by side lifting devices.

The design examples discussed above serve to illustrate the conflicting requirements of top castings. Top castings that locate the aperture near the outboard wall position the stacking forces closer to the stacking post for stability, but do not allow adequate cavity clearance for top picking devices. On the other hand, top castings that have an aperture located a substantial distance from the outboard wall provide adequate spacing for top lifting devices to operate, but require additional strength to maintain the support frames due to the increased moment forces acting on the stacking post imposed during stacking and lifting.

In light of the above design requirements and limitations, a need exists for a top casting which provides an aperture located near the outboard wall to reduce loads caused by stacking and lifting, provides adequate strength and cavity spacing to allow top picking of the cargo container, generates minimal interference with cargo container capacity, and provides capability for stacking with containers utilizing the 89 inch aperture spacing or the 96⅜ inch aperture spacing. Each preferred embodiment of the present invention achieves one or more of these results.

SUMMARY OF THE INVENTION

The present invention is a top casting apparatus and method preferably utilized in a support frame of non-standard cargo containers. Preferably, the top casting is secured to the upper end of a stacking post and to the outboard end of a horizontal support member that extending between the two side walls of the cargo container. The top casting has an aperture for stacking and top picking non-standard cargo containers. The top casting also has a cavity that is configured to allow for the insertion and rotation of a standard top picking device. The top casting positions the aperture near the outboard wall of the cargo container to reduce moment stresses caused by stacking and lifting. The outboard wall of the casting is preferably provided with an internal recess adequate to allow the rotation of a lifting device head after it has been inserted into the cavity of the top casting. By reducing the distance of the aperture from the outboard wall of the cargo container, the size of the top casting is decreased, the cargo container capacity is increased, the weight of the cargo container is decreased, and the manufacture of the top casting is simplified.

In highly preferred embodiments of the present invention, the apertures of opposed top castings on a support frame are capable of top lifting operations and are positioned at a distance of 96⅜ inches apart so as to be stackably compatible with other cargo containers utilizing the 96⅜ aperture distance. Most preferably, the aperture of each top casting is capable of receiving a top picking device and is located at a distance no greater than 3½ inches from the outboard wall of the cargo container so as to position the aperture as near as possible to the stacking post. Because the aperture is located closer to the outboard plane of the container, the operator has better visual access to the aperture, allowing the operator improved visible alignment during the top pick and securement operations.

By allowing insertion and rotation of the top picking device within the top casting cavity in the above-described manner, the stresses in the stacking post and header created by the forces imposed by stacking and top lifting are significantly reduced. Specifically, because the forces created from stacking and lifting are applied through the aperture closer to the stacking post, the distance of the moment arm acting on the stacking post and header is decreased, in turn decreasing the moment forces acting upon the stacking post and header. This reduced stress on the stacking post also reduces the potential deflection of the stacking post and top casting which, as a result, decreases the buckling effects within the header.

In one preferred embodiment of the present invention, the top casting has a single aperture in the upper wall of the top casting located at a distance of 96⅜ inches from the aperture of the opposed top casting. This aperture reduces the stresses created by stacking the container with other containers utilizing the 96⅜ inch aperture distance and also reduces the stresses created by top lifting the container.

In another preferred embodiment, the top casting has two apertures located in the upper wall of the top casting. The outboard aperture is located at a distance of 96⅜ inches from the outboard aperture of the opposed top casting. This outer aperture reduces the stresses created from stacking the container with other containers utilizing the 96⅜ inch aperture distance and from top lifting the container. The inboard aperture is located at a distance of 89 inches from the inboard aperture of the opposed top casting. This inboard aperture allows the container to be stacked with containers having the standard 89 inch aperture distance. Preferably, both preferred embodiments allow for top picking and stacking using the outboard aperture to reduce stresses on the container structure.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. In the drawings, wherein like reference numerals indicate like parts.

DETAILED DESCRIPTION OF PREFERRED EMBODIMENTS

Figure 1:
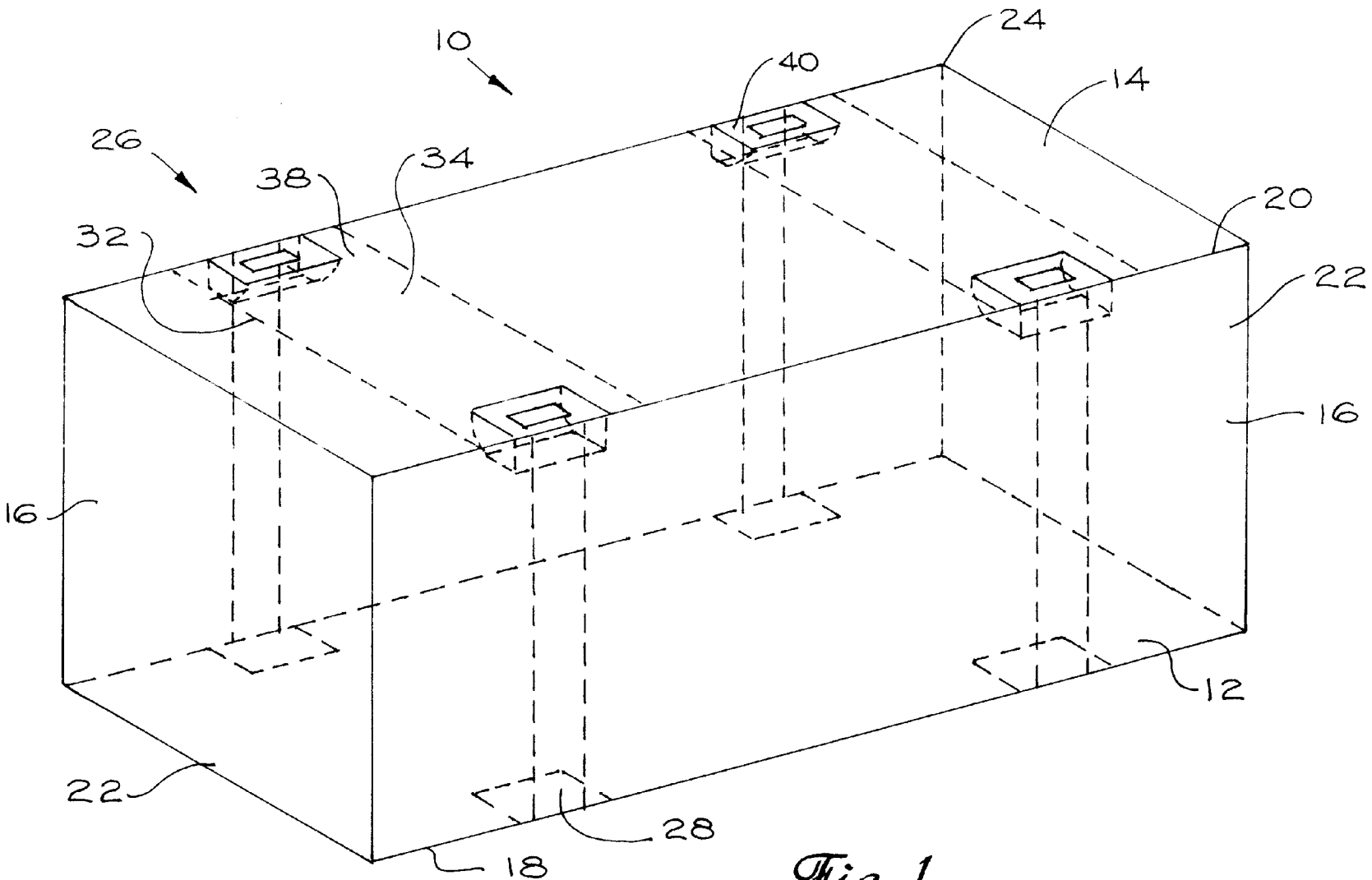
FIG. 1 is a perspective view of a container embodying the present invention.

FIG. 1 illustrates a cargo container 10 having a floor 12, a roof 14, an opposed pair of side walls 16 extending between the floor 12 and the roof 14 and adjoined thereto along lower horizontal edges and upper horizontal edges of the side walls 16, respectively. The container 10 also includes an opposed pair of end walls 22 adjoining the side walls 16, the floor 12, and the roof 14. Any one or more of the container walls can define or include a door or the container as is well-known to those skilled in the art. The container 10 can be integrated into a variety of freight hauling vehicles, such as to serve as a trailer or truck body, a railroad car body, a freight shipping container, and the like. In the illustrated embodiment by way of example only, the container 10 is a shipping container. However, as will be apparent to those skilled in the art, the invention is applicable to various container bodies, whether insulated or uninsulated. Container bodies can vary in shape and can be fully or partially enclosed. Container walls can be solid or apertured such as those used for shipping livestock. Also, this invention is not limited to cargo containers of a specific material, containers can be made of any material, for example, metal, wood, plastics, composites, etc.

To strengthen and maintain the structural integrity of the container 10, the container 10 preferably includes a pair of stacking frame assemblies 26 built into the structure of the container 10. It should be noted that any number of stacking frame assemblies 26 could be used, or none at all, and that using a pair within the cargo container 10 is only preferred. The stacking frames 26 provide additional structural strength and support for the container 10 (especially useful during stacking and lifting operations). The stacking frame assemblies 26 are preferrably positioned apart from each other at standard spaced locations along the length of the container 10. The stacking frames 26 are preferably spaced inwardly from the ends 22 of the container 10 so that the container 10 can be stacked with other domestic containers or ISO containers having varying overall dimensions, as will be understood by one skilled in the art. The method of attaching the stacking post assembly 26 to the container 10 is known to those of ordinary skill in the art.

Stacking frame assemblies 26 according to a preferred embodiment of the present invention are shown schematically in FIG. 1 and each include a pair of stacking posts 28. Each pair of stacking posts 28 are positioned opposite one another and are preferably located adjacent to (and most preferably against) a respective side wall 16. The stacking posts 28 at least partially support the weight of any container(s) stacked on top of the container 10. The stacking posts 28 also preferably transfer the lifting forces from the top casting 40 through to the floor 12 of the container 10. Each stacking post 28 is preferably formed as an elongated member having a vertically extending axis and an upper end 32.

A stacking post top casting 40 can be used regardless of the type of stacking frame assembly 26 utilized. The elements of a stacking frame assembly 26 can vary along with the placement of those elements with respect to each other. However, the top casting 40 will likely be used with a least one stacking post 28. Also, any number of top castings 40 can be used in cooperation with a stacking frame assembly 26. Although a pair of top castings 40 is preferred for use with a single stacking frame assembly 26, even a single top casting 40 can be useful in certain situations depending upon the configuration of the particular stacking frame assembly 26.

Figure 2:
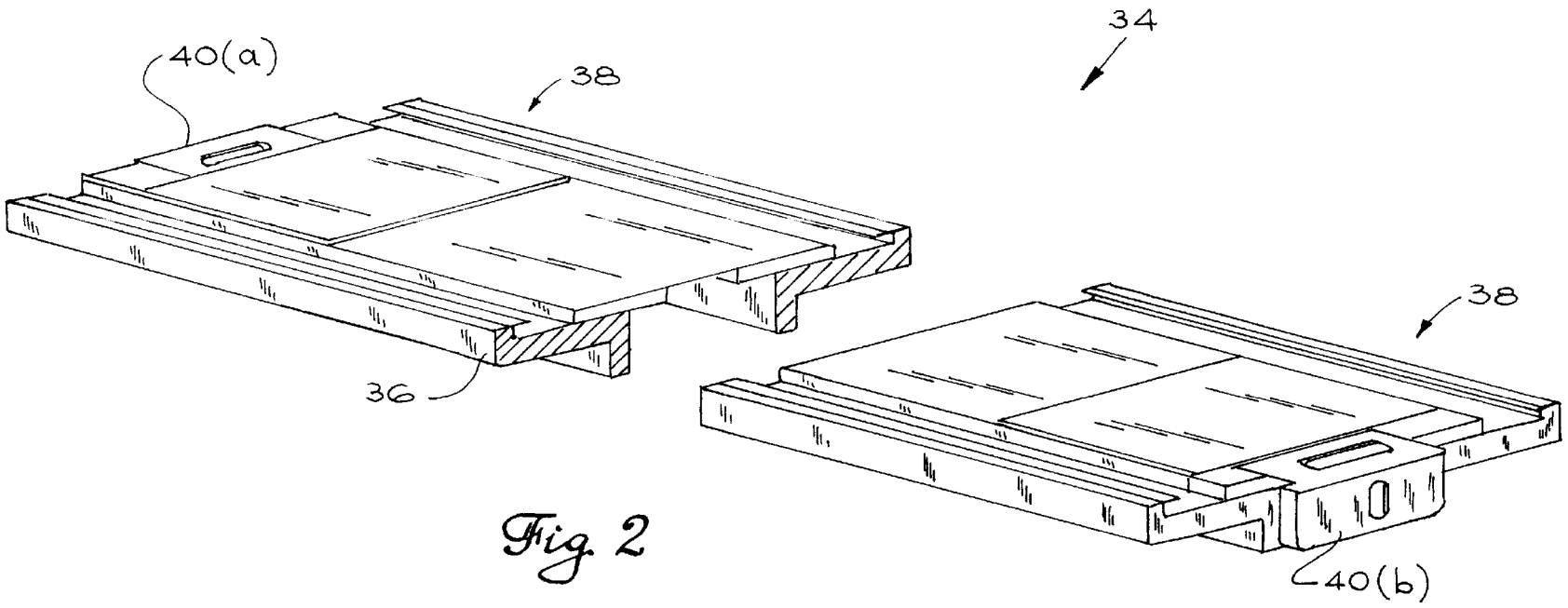
FIG. 2 is a perspective view of a header subassembly used in connection with the present invention and the stacking post assembly shown in FIG. 1.

As illustrated in FIG. 2, each stacking frame assembly 26 preferably includes a horizontal header subassembly 34 having a cross-member or beam 36. The header beam 36 has opposite outboard ends 38 which are interconnected with the upper ends 32 of the pair of stacking posts 28 by top castings 40 in a manner that will now be discussed.

Each stacking frame assembly 26 includes a system for coupling the container 10 to a lifting device or alternatively to another stacked container. While various systems can be employed, in the illustrated preferred arrangement the system includes preferably at least two top castings 40 positioned at an intersection of the header subassembly 34 and the upper ends 32 of the stacking posts 28. Accordingly, in the illustrated preferred arrangement, the opposed pairs of top castings 40 are mounted on the upper ends 32 of the stacking posts 28 and are spaced apart from each other laterally by a predetermined distance dependent upon the width of the container 10.

Preferably, the top casting 40 is welded to the stacking post 28 and is also welded to the outboard end 38 of the header subassembly 34. Although welding can be the preferred method of coupling the top casting 40 to the stacking frame assembly 26, other potential methods of coupling can be used and are known to those of ordinary skill in the art. For example, the top casting 40 can be coupled to the stacking post 28 and header subassembly 34 with mechanical fasteners.

Figure 3:
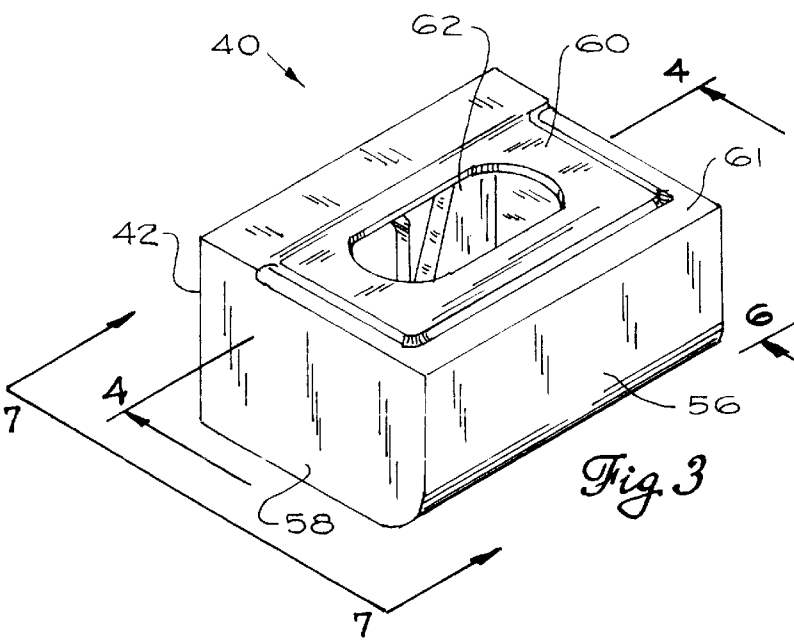
FIG. 3 is a perspective view of a top casting according to a first preferred embodiment of the present invention.

A first preferred embodiment of the stacking post top casting according to the present invention is illustrated in FIG. 3. This top casting (indicated generally at 40) has an aperture 62 located near an outboard wall 42, while still allowing for top picking operations. As can be seen in FIG. 1, each top casting 40(*a*) located on one side wall 16(*a*) faces a corresponding top casting 40(*b*) on the opposite side wall 16(*b*), thereby defining a pair of opposed top castings 40 most preferrably located in a common vertical plane parallel to the end walls 22 of the container 10. Top castings can be used regardless of location relative to other castings and any alignment thereto, a pair of opposed castings is merely preferred. FIG. 2 illustrates the structural assembly of the stacking frame 26 and the positions of the opposed pair of top castings 40. Each pair of opposed top castings 40 are preferably secured to the stacking posts 28 of each respective stacking frame assembly 26 to provide sufficient strength to withstand the applied loads during the stacking and handling of the container 10. The top castings need not be limited to rigid securement, but also can include other means of coupling.

It should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical communication with another element. Examples include directly securing one element to another (e.g., via welding, bolting, gluing, mating, etc.), elements which can act upon one another (e.g., via camming, pushing, or other interaction) and one element imparting motion directly or through one or more other elements to another element.

The top casting 40 is preferrably cast from a carbon steel that is capable of adequate strength and welding characteristics. Specifically, the top casting 40 can be made from a carbon steel with a minimum tensile strength of 65,000 psi, a minimum yield stress of 35,000 psi, and a minimum elongation of 22%. Other material compositions can be used that exhibit varying strength characteristics. Other metals, polymers, or combinations thereof can be used if strength characteristics permit. It should be noted that the top casting 40 need not be a casting. The top casting 40 can be a welded assembly, a machined component, a stamping, a molding, any combination thereof, or can be manufactured by other methods known to one of ordinary skill in the art.

Figure 7:
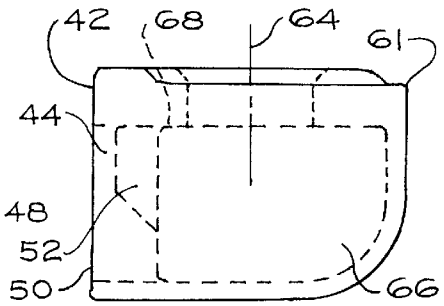
FIG. 7 is a side view of the top casting shown in FIG. 3, illustrating the interior thereof.
Figure 4:
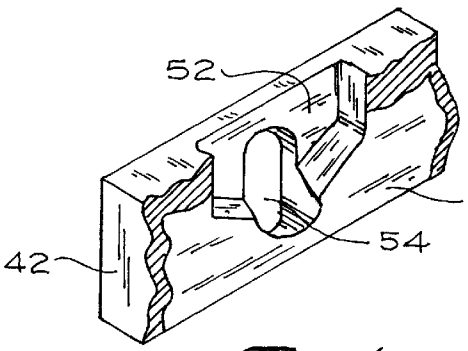
FIG. 4 is a perspective view of the top casting shown in FIG. 3, partially sectioned to show the interior thereof.

A first preferred embodiment of the top casting 40 according to the present invention is shown in more detail in FIGS. 3, 4 and 7. Each top casting 40 includes a hollow body having therein an upwardly opening aperture 62, an axis 64 of which passes therethrough at substantially the center of the aperture 62. The aperture is shaped and sized to receive a twist lock type cargo lifter device, a crane spreader with a locking device, or other lifter devices well-known to those skilled in the art. In the illustrated embodiment a lifting head device 1 is shown. The lifter devices 1 engage the interior of the top castings 40 via the aperture 62, and after reception by the top castings 40, are then rotated to a position of captive engagement. Such rotation can be through any angle, but most preferably is through about 90°. Lifting of the container 10 can then take place via the engaged lifter devices 1 and the top castings 40.

Figure 8:
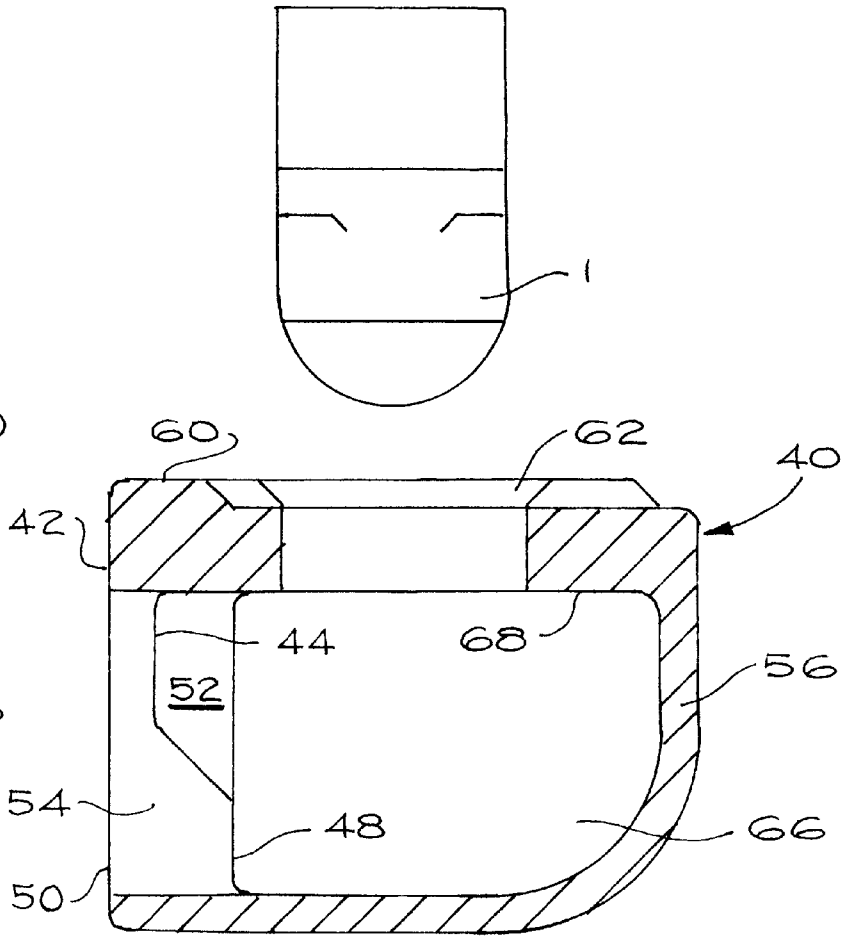
FIG. 8 is an elevational view of the top casting illustrated in FIGS. 3, 4, and 7, shown in cross-section with a lifting device prior to engagement with the top casting.
Figure 9:
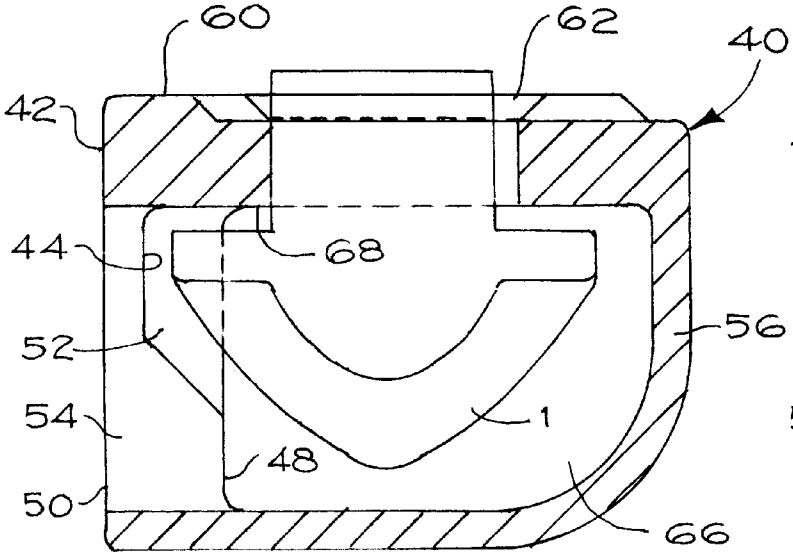
FIG. 9 is an elevational view of the top casting illustrated in FIGS. 3,4, 7, and 8, shown in cross-section with a lifting device after engagement with the top casting after engagement and rotation.

The top casting preferably has an inboard wall 56 and an outboard wall 42 interconnected with a pair of side walls 58. The top casting 40 also preferably includes an upper wall 60 which, with the inboard wall 56 and side walls 58, define therebetween a cavity 66. The side walls 58 and the inboard wall 56 are merely preferred, the invention itself lies within the structure and relative locations of the upper wall 60 and the outboard wall 42. The side walls 58 and the inboard wall 56 are preferably included to provide structural support to the top casting 40, and may be eliminated if no further support is necessary. The aperture 62, in combination with the configuration of the outboard wall 42, upper wall 60 and cavity 66 permit engagement of a top-picking device for lifting the container 10. Specifically, the aperture 62 permits the penetration of the top-picking device into the cavity 66 (See FIG. 8), the outboard wall 42 configuration permits the rotation of the top-picking device within the cavity 66 (See FIG. 9), and the upper wall 60 permits the top-picking device to apply the necessary lifting forces. The walls 42, 56, 58, 60 of the top casting 40 are sufficiently thick to support the loads created by stacking and lifting the container 10, and the cavity 66 is sufficiently large to provide clearance for the lifting device 1 and to permit the lifting device head to be turned therein as will be discussed in more detail below.

Preferably, the upper wall 60 of the top casting 40 is relatively thick and provides an engagement surface 68 for the lifting device 1. The upper wall 60 provides sufficient structural strength to accept stacking and lifting loads. In addition, the top surface of the upper wall 60 preferably has a shoulder 61 around its inboard perimeter to better fit to the shape of the header subassembly 34 as shown in FIG. 2. This shoulder 61 in the top surface of the upper wall 60 also provides for a moment resisting connection to the header subassembly 34.

The outboard wall 42 of the top casting 40 preferably has an outboard surface 50 and an inboard surface 48. The top castings 40 are positioned adjacent the side walls 16 of the cargo container 10. When the top casting 40 is mounted on a stacking post 28, the outboard surface 50 of the outboard wall 42 of the top casting 40 is preferably flush with the plane defined by the container's side wall 16. A portion 44 of the outboard wall 42 has a reduced thickness to create a recess 52 in the inboard surface 48 of the outboard wall 42. It is this portion 44 of the outboard wall 42 that permits the lifting device 1 head to be turned in the cavity 66 (See FIG. 9) even though the lifting device 1 head is inserted so close to the wall of the cargo container 10. The outboard wall 42 preferably has extending therethrough a side hole 54 communicating with the cavity 66. The side hole 54 can be used to visually check the location of the lifting device 1 head in the cavity 66 and/or to secure adjacent containers when positioned in a side-by-side relation such as on a cargo vessel.

The inboard wall 56 preferably has both a horizontal component extending from the outboard wall 42 and a verical component extending from the upper wall 60. Although the inboard wall 56 preferably combines both vertical and horizontal components into a single uniform wall, the inboard wall 56 can have two or more horizontal and vertical components. Also, the inboard wall 56 can be one or more walls assembled or formed together.

The aperture 62 is preferably sized to meet ISO standards. Specifically, the aperture 62 should have a width of about 2½ inches, and a length defined by about a 4⅞ inch diameter arc. Other aperture sizes and shapes can be employed that still allow for top picking by standard top lifting devices 1. The apperture 62 is only limited in shape as to allow the passage of the lifting device 1 head and provide an engagement surface 68 for the rotated lifting device 1 head to apply lifting forces. The axes 64 of the receiving apertures 62 of the opposed top castings 40 are preferrably located at a spacing of about 96⅜ " inches across the width of the container 10. This provides about a 3 inch distance from the outboard surface 50 to the aperture axis 64 when the container width is about 102⅜ inches. This aperture 62 is used to position the stacking and lifting forces closer to the axis of the stacking post 28 to reduce the associated stresses.

As mentioned above, the recess 52 is sufficiently large to allow for rotation of the lifting device 1 in the cavity 66. However, the recess 52 is not excessively large so as to compromise the necessary strength of the outboard wall 42. In highly preferred embodiments of the present invention, the recess 52 is triangular in shape with rounded corners. The triagular shape is preferably oriented so that the top edge is parallel to the upper wall 60 and so that the triangular shape points down away from the upper wall 60. The top portion of the triangular shape is recessed into the inboard surface 48 of the outboard wall 42 approximately 13/16 inch deep. This depth of the recess 52 is preferably maintained for 1¼ inches from the top of the triangular shape. After the 1¼ inches from the top, the recess 52 is preferably chamfered to the inboard surface 48 over a distance of 1 inch as is best seen in FIG. 4. The shape of this recess 52 permits the rotation of the lifting device 1 head into its locking positon after it is inserted through the aperture 62. Other recess shapes are possible for this same purpose. The triangular shape is merely one possible shape, and the dimensions of the recess 52 should not be limited to those described above. However, the shape of the recess 52 is preferably at least partially determined by the shape of the lifting device 1 head, its position when inserted, and the shape of its path created when rotated within the cavity 66. The depth of the recess 52 is also variable. For example, if the outboard wall 42 has sufficient strength, the recess 52 could in actuality be a hole through the outboard wall 42. The depth of the recess 52 in the inboard surface 48 of the outboard wall 42 can vary anywhere between about ⅛ inch and the thickness of the outboard wall. More preferably the recess depth will range between about ¼ inch and about ⅞ inch. Most preferably the recess will be approximately 13/16 inch deep.

Figure 5:
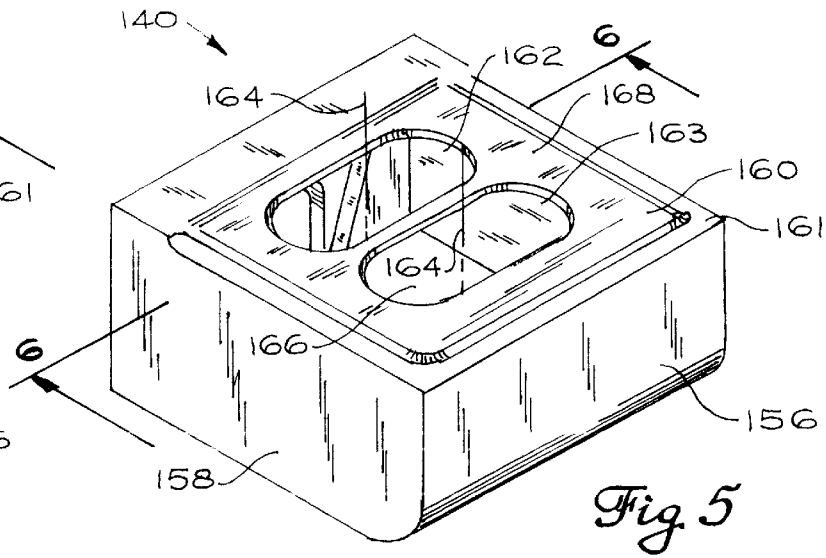
FIG. 5 is a perspective view of the top casting according to a second preferred embodiment of the present invention.
Figure 6:
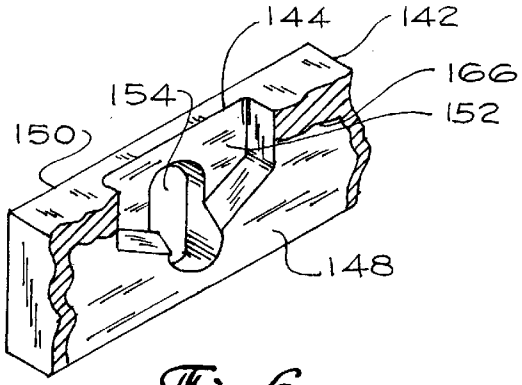
FIG. 6 is a perspective view of the top casting shown in FIG. 5, partially sectioned to show the interior thereof.

A second preferred embodiment of the present invention is illustrated in FIGS. 5 and 6. The top casting 140 of the second preferred embodiment is substantially the same as the top casting 40 of the first preferred embodiment, with the exception of the differences described below.

The top casting 140 according to the second preferred embodiment of the present invention is shown in more detail in FIGS. 5 and 6. Each top casting 140 includes a hollow body having two upwardly opening apertures: an outboard aperture 162 and an inboard aperture 163. Each aperture 162, 163 has an axis 164. The outboard aperture 162 can receive a twist lock type cargo lifter device, a crane spreader with a locking device, or other conventional lifter devices. The lifter devices engage the interior of the top castings 140 via the outboard aperture 162, and after reception by the top castings 140, are then preferably rotated to a position of captive engagement as described above, whereby lifting of the container 10 can then take place via the lifter devices 1 and the top castings 140.

The top casting 140 preferably has an inboard wall 156 and an outboard wall 142 interconnected with a pair of side walls 158. The top casting 140 also preferably includes an upper wall 160 which, with the inboard wall 156 and side walls 158, define therebetween a cavity 166. The side walls 158 and the inboard wall 156 are merely preferred, the invention itself lies within the structure and relative locations of the upper wall 160 and the outboard wall 142. The side walls 158 and the inboard wall 156 are preferably included to provide structural support to the top casting 140, and may be eliminated if no further support is necessary. The outboard aperture 162, in combination with the configuration of the outboard wall 142, upper wall 160 and cavity 166 permit engagement of a top-picking device for lifting the container 10. Specifically, the outboard aperture 162 permits the penetration of the top-picking device into the cavity 166, the outboard wall 142 configuration permits the rotation of the top-picking device within the cavity 166, and the upper wall 160 permits the top-picking device to apply the necessary lifting forces. The walls 142, 156, 158, 160 of the top casting 140 are sufficiently thick to support the loads created by stacking and lifting the container 10, and the cavity 166 is sufficiently large to provide clearance for the lifting device 1 and to permit the lifting device 1 head to be turned therein as will be discussed in more detail below.

Preferably, the upper wall 160 of the top casting 140 is relatively thick and provides an engagement surface 168 for the lifting device 1. The upper wall 160 provides sufficient structural strength to accept stacking and lifting loads. In addition, the top surface of the upper wall 160 preferably has a provides a shoulder 161 around its inboard perimeter to better fit to the shape of the header subassembly 34. This shoulder 161 in the top surface of the upper wall 160 also provides for a moment resisting connection to the header subassembly 34.

The outboard wall 142 of the top casting 140 preferably has an outboard surface 150 and an inboard surface 148. The top castings 140 are positioned adjacent the side walls 16 of the cargo container 10. When the top casting 140 is mounted on a stacking post 28, the outboard surface 150 of the outboard wall 142 of the top casting 140 is preferably flush with the plane defined by the container's side wall 16. A portion 144 of the outboard wall 142 has a reduced thickness to create a recess 152 in the inboard surface 148 of the outboard wall 142. It is this portion 144 of the outboard wall 142 that permits the lifting device 1 head to be turned in the cavity 166 even though the lifting device 1 head is inserted so close to the wall of the cargo container 10. The outboard wall 142 preferably has extending therethrough a side hole 154 communicating with the cavity 166. The side hole 154 can be used to visually check the location of the lifting device 1 head in the cavity 166 and/or to secure adjacent containers when positioned in a side-by-side relation such as on a cargo vessel.

The apertures 162, 163 are preferably sized to meet ISO standards. Specifically, the apertures 162, 163 should have a width of about 2½ inches, and a length defined by about 4⅞ inch diameter arc. Other aperture sizes, described above, can be available that still allow for top picking by standard top lifting devices 1. The axes 164 of the outboard apertures 162 of the opposed top castings 140 are preferrably located at a spacing of about 96⅜" inches across the width of the container 10. This provides about a 3 inch distance from the outboard surface 150 to the aperture axis 164 when the container width is about 102⅜ inches. The outboard aperture 162 is used to position the stacking and lifting forces closer to the axis of the stacking post 28 to reduce the associated stresses. Additionally, the outboard aperture 162 can be used to accept IBC connectors in order to stack other containers using the 96⅜ inch aperture distance. The inboard aperture 163 is not preferably used for top picking. However, it can be used to accept IBC connectors in order to stack other containers using the 89 inch aperture distance.

The recess 152 within the cavity 166 to allow for the rotation of the lifting device 1 is similar to that described above in the first preferred embodiment. It must be stressed that although the recess shape described above is the preferred shape, other shapes are available which will accomplish the purpose of allowing rotation of the lifting device 1 head while still providing the necessary strength in the outboard wall 142. These alternative recesses fall within the present invention.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

Having thus described the invention, what is claimed is:

1. A top casting for a cargo container, the top casting comprising:

an outboard wall having an outboard surface and an inboard surface; and an upper wall coupled to the outboard wall, the upper wall and outboard wall defining an interior of the top casting, the upper wall having an aperture defined therein in communication with the interior of the top casting, the aperture having a centrally located axis located no more than about 3.5 inches away from the outboard surface, the inboard surface having a recess defined therein having a depth between and including ¼ and ⅞ inches to permit rotation of a top lifting device within the interior of the top casting.

2. A top casting as described in claim 1, wherein the upper wall and the outboard wall are coupled substantially perpendicular with respect to one another.

3. A top casting as described in claim 1, wherein the outboard wall and the upper wall at least partially define a cavity.

4. A top casting as described in claim 3, wherein the cavity is further defined by at least one side wall.

5. A top casting as described in claim 3, wherein the cavity is further defined by an inboard wall.

6. A top casting as described in claim 1, wherein the cargo container has a side wall, and wherein the outboard surface of the top casting is substantially within the plane defined by the side wall of the cargo container.

7. A top casting as described in claim 1, wherein the recess has a depth of about 13/16 inches.

8. A top casting as described in claim 1, wherein the distance from the axis of the aperture to the outboard surface is about 3 inches.

9. A top casting as described in claim 1, wherein the upper wall has a first aperture and a second aperture defined therein in communication with the interior of the top casting, the second aperture located inboard of the first aperture.

10. A cargo container having at least one stacking frame having a pair of opposed top castings, each top casting comprising:

an outboard wall having an outboard surface and an inboard surface; and an upper wall coupled to the outboard wall, the upper wall and outboard wall at least partially defining an interior of the top casting, the upper wall having an aperture defined therein in communication with the interior of the top casting, the aperture having a centrally located axis located a distance greater than 89 inches from the central axis of the opposed top casting, the inboard surface having a recess defined therein having a depth between and including ¼ and ⅞ inches to permit rotation of a top lifting device within the interior of the top casting.

11. A cargo container top casting for releasable engagement with a connecting device having a head, the top casting comprising:

a upper wall having an aperture defined therethrough, the aperture adapted to removably receive the head of the connecting device;

an outboard wall coupled to the upper wall, the outboard wall having a recess defined therein into which the head of the connecting device is movable upon engagement with the top casting.

12. A top casting as described in claim 11, wherein the upper wall and the outboard wall are coupled substantially perpendicular with respect to one another.

13. A top casting as described in claim 11, wherein the outboard wall and the upper wall partially define a cavity.

14. A top casting as described in claim 13, wherein the cavity is further defined by at least one side wall.

15. A top casting as described in claim 13, wherein the cavity is further defined by an inboard wall.

16. A top casting as described in claim 11, wherein the cargo container has a side wall, and wherein the outboard surface of the top casting is substantially within the plane defined by the side wall of the cargo container.

17. A top casting as described in claim 11, wherein the recess has a depth of about 13/16 inches.

18. A top casting as described in claim 11, wherein the distance from the axis of the aperture to the outboard surface is about 3 inches.

19. A top casting as described in claim 11, wherein the upper wall has a first aperture and a second aperture defined therein in communication with the interior of the top casting, the second aperture located inboard of the first aperture.

20. A method of coupling a cargo container with a connecting device having a head rotatable from an engaging position to a locking position, the top casting having an outboard wall having an outboard surface and an inboard surface, and an upper wall coupled to the outboard wall, the upper wall and outboard wall defining an interior of the top casting, the upper wall having an aperture defined therein in communication with the interior of the top casting, the inboard surface having a recess defined therein, the method comprising the steps of:

inserting the head through the aperture and into the interior of the top casting, the head being in the engaging position; and rotating the head into or through the recess on the inboard surface of the outboard wall.

21. A method as described in claim 20, wherein the connecting device is a top lifting device, the method further comprising lifting the cargo container with the top lifting device.

22. A method as described in claim 20, wherein the head is rotated into the recess on the inboard surface into the locking position.

* * * * *